US005573628A

United States Patent [19]

Boldrini

[11] Patent Number: 5,573,628

[45] Date of Patent: Nov. 12, 1996

[54] DEVICE FOR APPLYING SEALING LABELS TO CONTAINERS

[75] Inventor: Fulvio Boldrini, Ferrara, Italy

[73] Assignee: G.D Societa per Azioni, Bologna, Italy

[21] Appl. No.: 356,873

[22] Filed: Dec. 15, 1994

[30] Foreign Application Priority Data

Dec. 23, 1993 [IT] Italy ..... BO93A0518

[51] Int. Cl.[6] ..... B65C 9/36

[52] U.S. Cl. ..... 156/483; 156/492; 156/485; 156/484; 156/475; 156/566; 156/571; 156/556

[58] Field of Search ..... 156/492, 485, 156/483, 484, 475, 566, 568, 571, 556, 212

[56] References Cited

U.S. PATENT DOCUMENTS

| | | | |
|---|---|---|---|
| 1,185,848 | 6/1916 | Smith | 156/485 X |
| 1,405,190 | 1/1922 | Durkee et al. | 156/485 X |
| 1,425,250 | 8/1922 | Gwinn et al. | 156/485 |
| 1,939,507 | 12/1933 | Mason | 216/33 |
| 2,005,802 | 6/1935 | Oslund | 156/566 |
| 2,115,061 | 4/1938 | Darling | 156/571 X |
| 2,267,549 | 12/1941 | Bronander | 156/484 |
| 4,564,412 | 1/1986 | Oberdorf | 156/484 |
| 4,620,891 | 11/1986 | Applegate et al. | 156/484 X |
| 4,655,871 | 4/1987 | Mattei et al. | 156/484 |
| 4,718,216 | 1/1988 | Focke et al. . | |
| 5,356,508 | 10/1994 | Watanabe | 156/492 X |

FOREIGN PATENT DOCUMENTS

| | | | |
|---|---|---|---|
| 0144650 | 6/1985 | European Pat. Off. . | |
| 2583380 | 12/1986 | France . | |
| 531304 | 1/1941 | United Kingdom | 156/484 |
| 2055747 | 3/1981 | United Kingdom | 156/571 |

*Primary Examiner*—David A. Simmons
*Assistant Examiner*—Steven J. Helmer
*Attorney, Agent, or Firm*—Ladas & Parry

[57] ABSTRACT

A device for applying sealing labels to containers defined partially by two parallel faces and by a further face connecting the two parallel faces; the device including a conveying device for feeding containers to a labeling station, and a supply device for supplying labels and presenting at least one retaining device for retaining two opposite end portions of the label; the conveying device consisting of a conveyor for successively conveying the containers with the further face downstream in relation to the traveling direction of the conveyor; and an actuating device being provided for moving the retaining device between a position, assumed at least at the labeling station, of interference with the path of each container on the conveyor, and a position of noninterference with the aforementioned path.

15 Claims, 3 Drawing Sheets

DEVICE FOR APPLYING SEALING LABELS TO CONTAINERS

BACKGROUND OF THE INVENTION

The present invention relates to a device for applying sealing labels to containers.

In particular, the present invention relates to a device of the above type for applying so-called "government stamps" to the top portions of cigarette packets.

U.S. Pat. No. 4,718,216 relates to a device, designed to operate in conjunction with a cigarette packing machine with two wrapping lines, wherein the packets of cigarettes coming off each wrapping line are gradually stacked vertically, by an intermittent upward-feed lift member, in the vicinity of a labeling device.

Each labeling device substantially comprises a suction roller for successively feeding the labels adhering to its periphery to a gumming device, and then to a labeling station where the labels are applied to the bottom packet in the stack formed by the lift member.

Each suction roller has a number of peripheral fork elements movable radially in relation to the roller and presenting prongs on the ends of which the gummed label is retained by suction.

When applying the label to the bottom packet in the stack, the rest of the stack must be raised off the bottom packet by a sufficient distance to enable the fork element on the roller to fit between the bottom packet and the stack, and the prongs of the fork element to enclose the end of the packet. As a result, prior to the arrival of the next packet for labeling, each labeled packet must be raised, together with the rest of the stack, by a distance considerably greater than the thickness of the packet; which movement, to prevent damaging the packets by subjecting them to severe mechanical stress, is performed relatively slowly, thus seriously impairing the operating speed of the device and hence the packing machine as a whole.

Moreover, as the fork element is withdrawn from the labeled packet, the friction produced by the fork element frequently results in either partial or total removal of the label.

SUMMARY OF THE INVENTION

It is an object of the present invention to provide a device of the above type designed to overcome the aforementioned drawbacks typically associated with known devices, and which, in particular, provides for extremely high-speed labeling of the packets.

It is a further object of the present invention to provide a device of the above type, designed to effectively prevent detachment of the applied labels.

According to the present invention, there is provided a device for applying sealing labels to containers; a portion of each said container being defined by two substantially parallel faces, and by a further face connecting said two faces; and said device comprising conveying means for feeding containers to a labeling station; supply means for feeding labels to said labeling station; and means for applying adhesive material to said labels; said supply means presenting retaining means for retaining two opposite end portions of at least one said label; and said conveying means successively conveying said containers with said further face maintained downstream in relation to the traveling direction of the conveying means; characterized in that it comprises actuating means for moving said retaining means between a position, assumed at least at said labeling station, of interference with the path of each container conveyed by said conveying means, so as to adhere respective portions of said label to corresponding portions of said faces and said further face, and a position of noninterference with said path.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
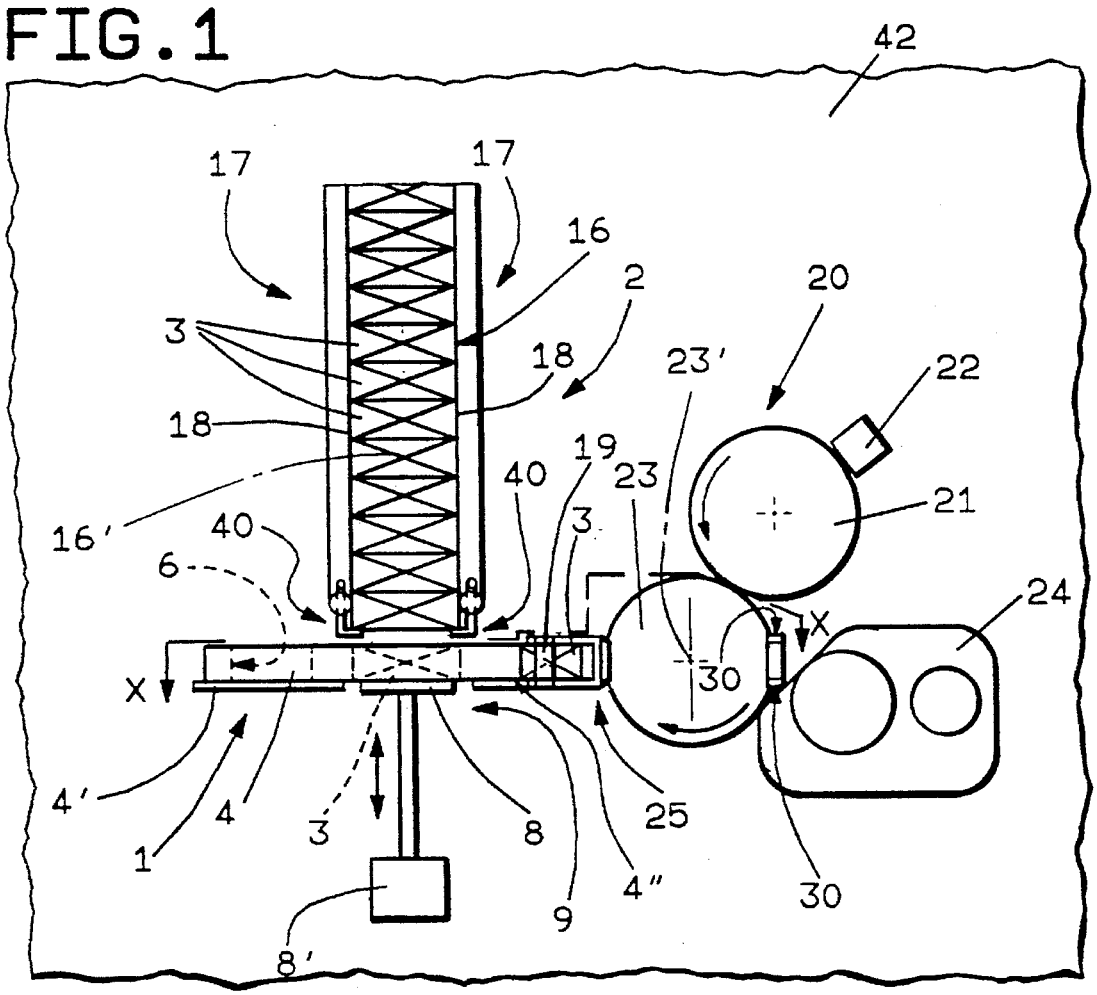
FIG. 1 shows a partial schematic front view, with parts removed for clarity, of a packing line featuring a device for applying sealing labels to containers in accordance with the present invention.
Figure 2:
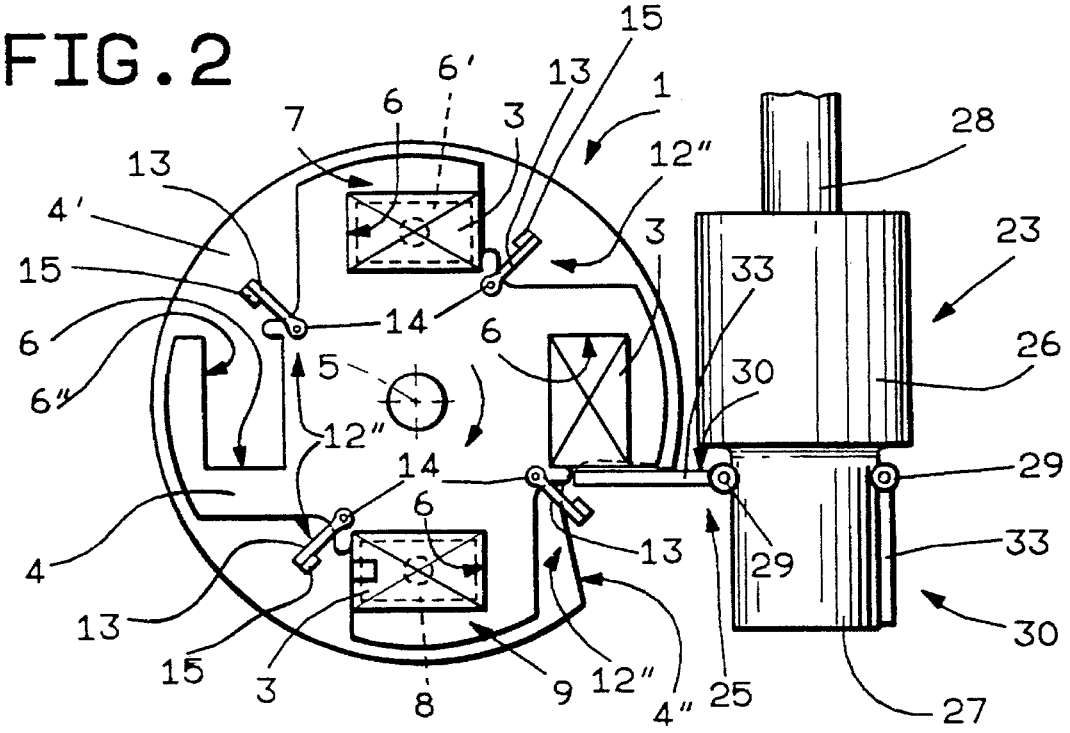
FIGS. 2, 3 and 4 show details, along line X—X in FIG. 1, of the FIG. 1 device in three different operating conditions.
Figure 3:
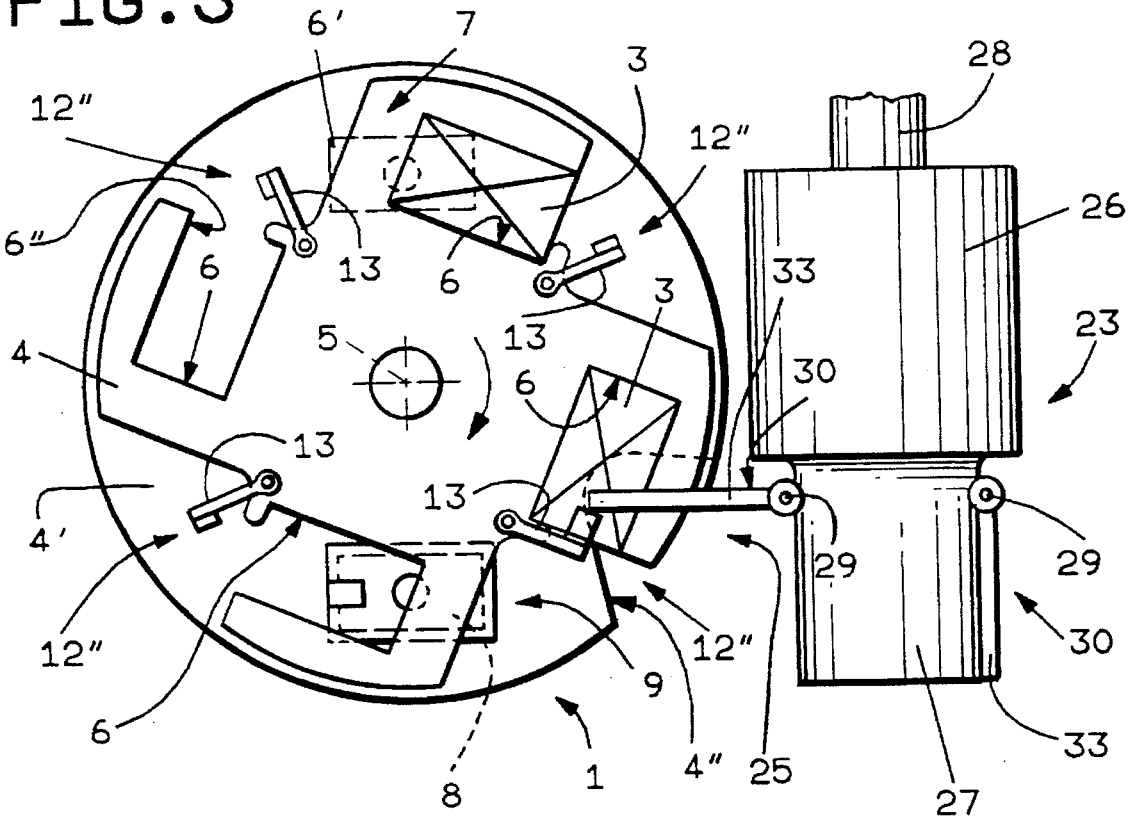
Figure 4:
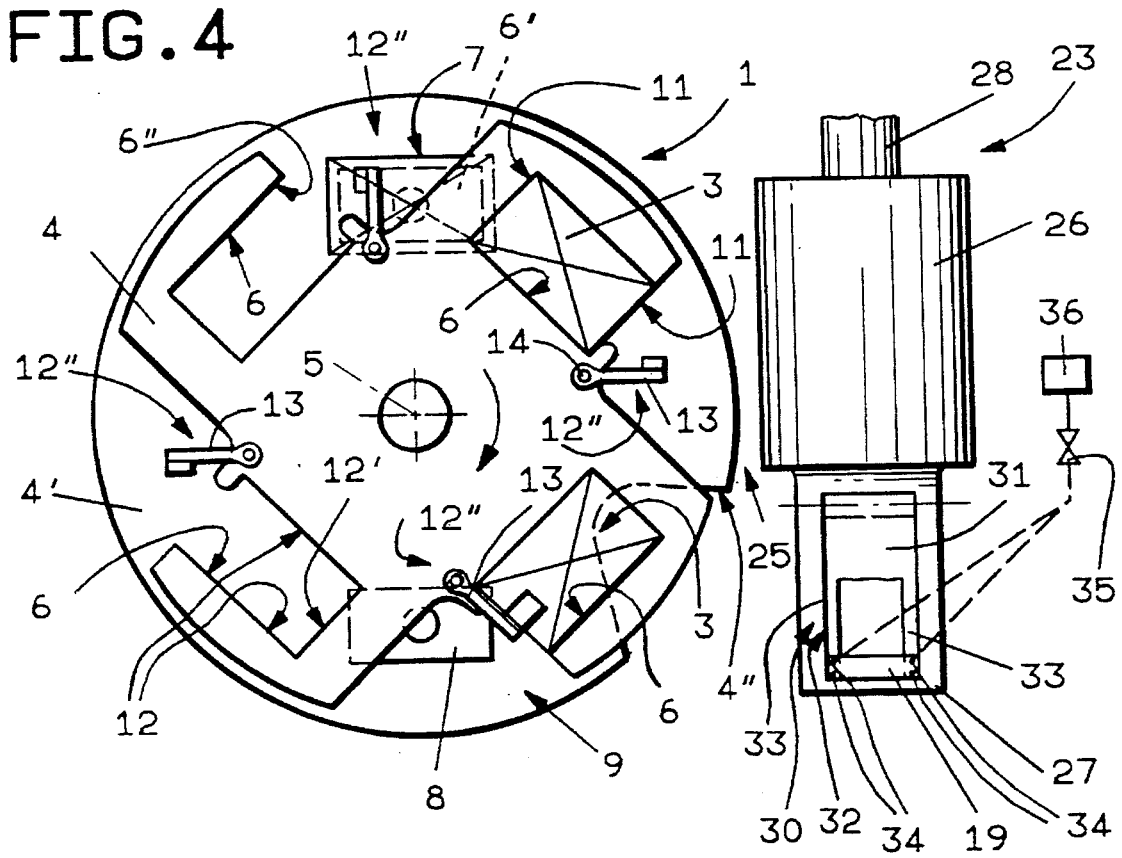
Figure 5:
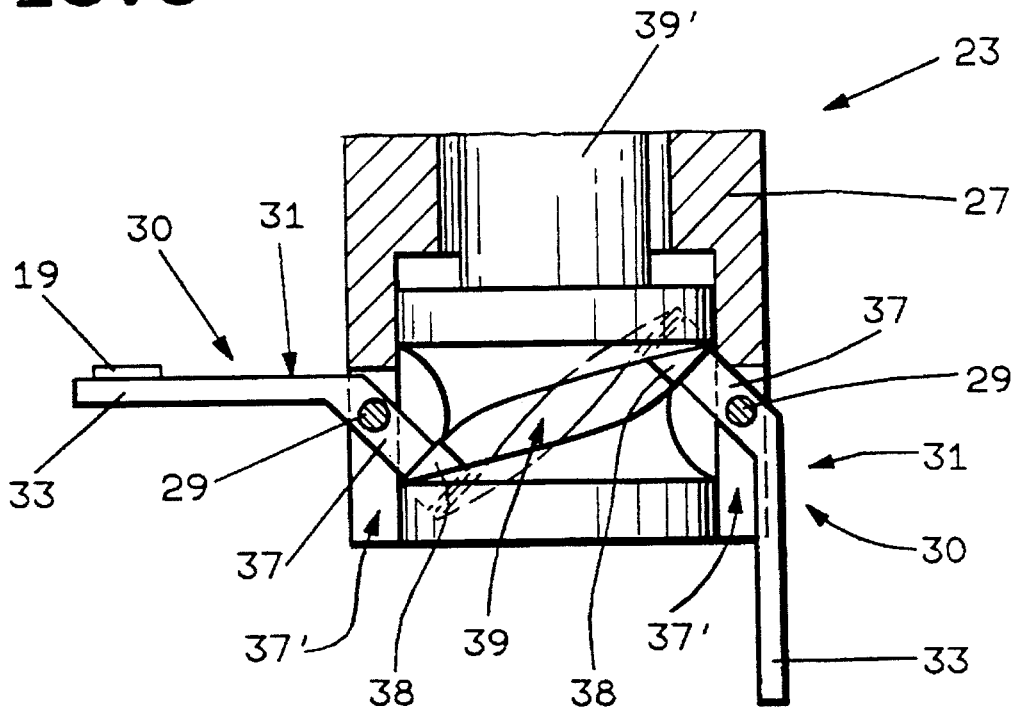
FIG. 5 shows a larger-scale, partially sectioned view of a detail of the device in FIGS. 1 to 4.

Numeral 1 in FIGS. 1 and 2 indicates the output unit of a packing line indicated as a whole by 2 and for forming in known manner containers consisting of packets of cigarettes 3. Output unit 1 substantially comprises a conveying device or conveyor in turn comprising a wheel 4 rotating clockwise (in FIGS. 2 to 4) in constant steps (of 90° in the example shown) about a vertical axis 5, and presenting a number (four in the example shown) of angularly equidistant peripheral seats 6 for housing respective packets 3. At each stop of wheel 4, a packet 3 is inserted inside a first seat 6 by a vertical-operating lift element 6' at an input station 7 at the top in FIGS. 2 to 4; and, at the same time, a vertical-operating lift element 8, moved back and forth by an actuating element 8' and cooperating with a counterpush element (not shown), expels another packet 3 from a second seat 6 diametrically opposite first seat 6 and at an output station 9 (FIGS. 2 to 4). Wheel 4 rotates over a fixed disk element 4' coaxial with wheel 4 and presenting two openings (not shown) for the passage, through disk element 4' of lift elements 6' and 8 respectively.

Each packet 3 is substantially in the form of a flat, elongated parallelepipedon, and seats 6 are so formed and arranged as to house packet 3 with the larger faces 10 (FIG. 6) positioned horizontally, and the two smaller vertical lateral faces 11 positioned substantially radially in relation to wheel 4 (FIG. 4), so that lift element 8 acts on the bottom larger face 10 of each packet 3.

As shown in FIGS. 2 to 4, each seat 6 of wheel 4 presents a substantially rectangular horizontal section reproducing the shape and size of the larger faces 10 of packet 3; is defined at two opposite sides by two parallel, vertical walls 12 (FIG. 4) perpendicular to the diameter of wheel 4; is defined by a vertical wall 12' perpendicularly connecting the two ends of walls 12 upstream in relation to the rotation direction of wheel 4; and presents an opening 6" at the other end of walls 12, i.e. at the edge facing downstream in relation to the rotation direction of wheel 4.

Four portions of wheel 4, each located close to the radially inner portion of the open front end of each seat 6, support, on top of wheel 4, respective elements 12" for clamping labels 19 to packets 3 as described in more detail later on.

Each clamping element 12" comprises a substantially horizontal lever 13 fitted at one end to a vertical pin 14 (FIGS. 2 and 4) in turn fitted to wheel 4 and connected in known manner to actuating means (not shown) by which it is oscillated about its axis as described later on. The other end of each lever 13 is fitted rigidly, on the surface facing upstream in relation to the rotation direction of wheel 4, with a pad 15 of resilient material.

Packets 3 are successively expelled from seats 6 of wheel 4 on to the bottom of a vertical stack 16 consisting of a number of packets 3 stacked one on top of the other with respective faces 10 contacting one another.

The bottom of stack 16 is defined by lift element 8 (FIG. 1) which is moved back and forth vertically by a distance approximately equal to but no less than the distance between the two larger faces 10 of each packet 3.

The portion of stack 16 over output station 9 is defined laterally, at two horizontally opposite sides and in known manner, by conveying means comprising two vertical conveyor belts 17 having respective inner transportation branches 18 moved intermittently upwards by drive means not shown. Hereinafter, the assembly comprising conveyor belts 17 and lift element 8 will also be referred to as a conveying device for conveying packets 3 along a path defined in FIG. 1 by the longitudinal axis 16' of stack 16.

Adjacent to a lateral portion of wheel 4, there is provided a device for supplying labels 19 and indicated as a whole by numeral 20.

As shown particularly in FIG. 1, supply device 20 comprises a roller 21 rotating anticlockwise in steps about a horizontal axis perpendicular to the FIG. 1 plane, and which provides in known manner for withdrawing, and retaining by suction, single labels 19 from the bottom of a feedbox 22. Roller 21 successively feeds labels 19 to a supply device comprising a roller 23 rotating clockwise in steps about an axis 23' parallel to the rotation axis of roller 21, and which provides for successively feeding labels 19, retained by suction, to a known device for applying adhesive material and indicated schematically by block 24. Labels 19 coated on one surface with adhesive material are then fed by roller 23 to a station 25 for applying labels 19 to packets 3, and which is located along the path traveled by seats 6 as wheel 4 is rotated. In the embodiment shown, rollers 21 and 23 rotate in steps of 180°.

As shown particularly in FIGS. 2 to 4, roller 23 comprises two substantially cylindrical bodies 26 and 27 —respectively at the top and bottom in FIGS. 2 to 4—coaxial with each other, connected to each other at their respective bases, and fitted coaxially to a hollow shaft 28 connected to drive members (not shown) for rotating it in steps as described with reference to roller 23.

Cylindrical body 26 is larger in diameter than cylindrical body 27, and is located horizontally alongside, with a generating line substantially tangent to, the portion of wheel 4 at station 25 wherein labels 19 are applied to packets 3.

Cylindrical body 27—hereinafter also referred to as a "supporting element"—supports for rotation, by means of integral pins 29 and at respective diametrically opposite portions close to the connection of bodies 26 and 27 (FIGS. 2 to 5), two identical two-armed levers 30 oscillating about the axes of respective pins 29.

Each two-armed lever 30 (FIG. 4) comprises a first arm 31 outside cylindrical body 27 and supporting a fork element 32 on its free end. Fork element 32 comprises two parallel prongs 33 constituting respective extensions of arm 31 and separated by a distance approximately equal to but no more than the length of label 19; and, close to the free ends of prongs 33, the surfaces of prongs 33 facing outwards, in use, of cylindrical body 27 present a number of holes 34 (FIG. 4) communicating via valve means 35 with a suction source indicated schematically by block 36.

The second arm 37 of each two-armed lever 30 extends partially inside cylindrical body 27 through an opening 37' (FIG. 5), and supports a roller 38 engaging an actuating element comprising a fixed cam element 39 housed inside cylindrical body 27 and fitted coaxially to a fixed shaft 39' housed coaxially inside hollow shaft 28.

Hereinafter, all the elements constituting two-armed levers 30 will be referred to collectively as "retaining means" for retaining labels 19.

Figure 6:
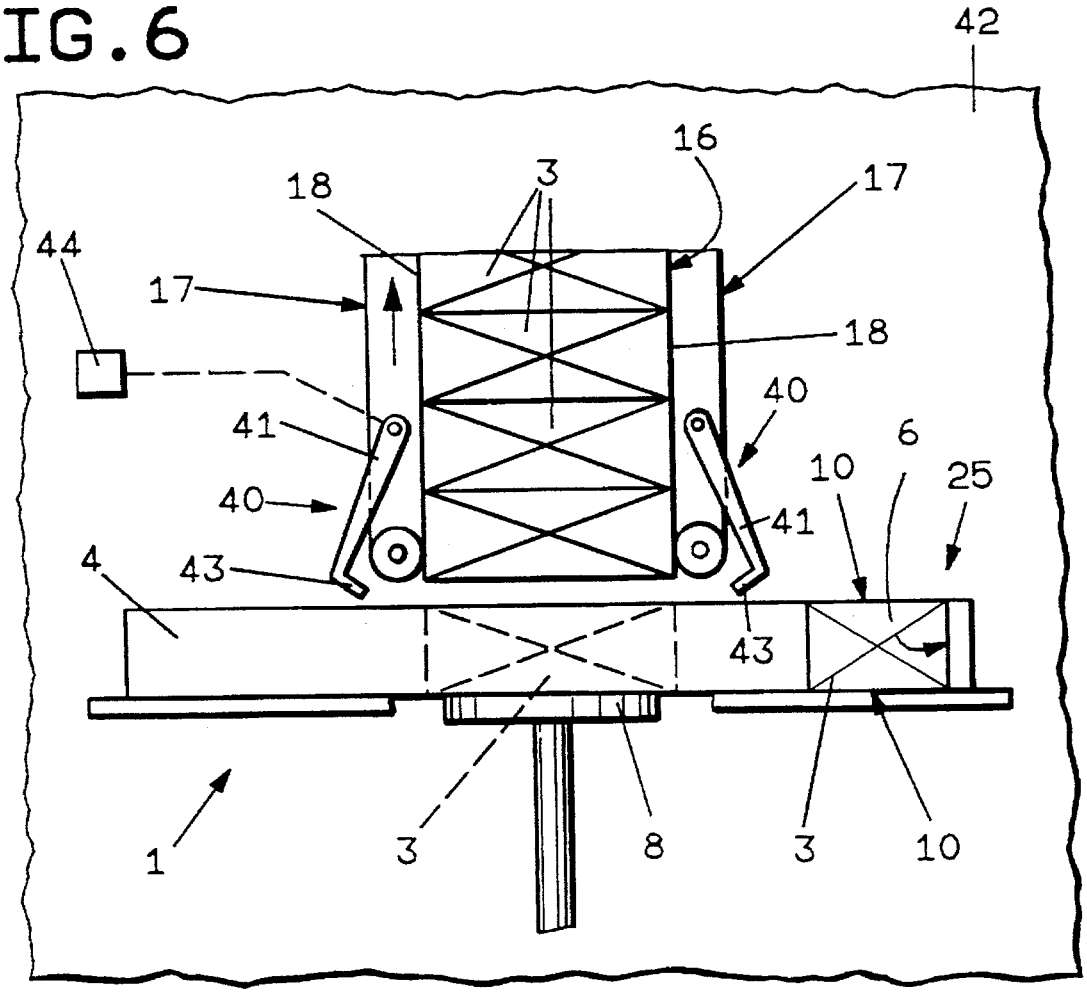
FIG. 6 shows a larger-scale view of a further detail in FIGS. 1 to 4.

Close to the bottom of conveyor belts 17, there are provided positioning means 40 (FIGS. 1 and 6) for positioning packets 3 forming part of stack 16. As shown in FIG. 6, for each conveyor belt 17, positioning means 40 comprises a supporting member comprising a substantially vertical bar 41 pivoting at the top end on vertical wall 42 of the base of packing line 1, and rotating about a horizontal axis parallel to axis 23'; and the bottom end of each bar 41 supports an appendix 43 extending substantially horizontally towards the longitudinal axis of stack 16. Bars 41 (FIG. 6) are connected in known manner (not shown) to actuating means 44 for rotating bars 41 about their respective pivots and so moving appendixes 43 towards each other (FIG. 1) or away from each other (FIG. 6). When brought towards each other, appendixes 43 are so positioned that their respective upper surfaces are slightly above the top larger faces 10 of packets 3 inside seats 6 of wheel 4.

In actual use, at each step of wheel 4, a packet 3 is inserted inside a seat 6 by lift element 6' at input station 7, and another packet 3 is expelled from a seat 6 by lift element 8 at output station 9.

When wheel 4 is rotated, the packets 3 flanked by conveyor belts 17 are maintained stationary, and are supported on appendixes 43 of bars 41 to prevent them from falling (FIG. 1).

Conversely, when a packet 3 is expelled from seat 6 at output station 9, conveyor belts 17 are started momentarily; appendixes 43 are moved away from each other (FIG. 6); lift element 8 pushes packet 3 between inner branches 18 of conveyor belts 17; appendixes 43 are again moved towards each other; and lift element 8 is moved back down into the FIG. 1 position.

The labels 19 to be applied to packets 3 are withdrawn successively from the bottom of feedbox 22 and fed to roller 23 by roller 21; and each label 19 is fed by roller 23 to station 25 with its exposed surface coated at least partially with adhesive material applied by device 24.

At the point of contact between rollers 21 and 23, each label 19 on roller 21 is transferred to a fork element 32; and, upon transfer of label 19 from roller 21, the holes 34 in prongs 33 of the receiving fork element 32 are connected by valve element 35 to suction source 36, so that the two longitudinal ends of label 19 are gripped and retained by suction on the end portions of prongs 33. During transfer, cam element 39 maintains the receiving fork element 32 against the cylindrical surface of body 27, in the position shown to the right in FIG. 2.

When roller 23 is again rotated, so that fork element 32 supporting label 19 is transferred from the point of substantial tangency of rollers 21 and 23 to station 25, cam element 39 rotates fork element 32 so that it is arrested perpendicular to axis 23', in the position shown to the center of FIG. 2.

When the fork element 32 in question reaches station 25, wheel 4 is stationary, but, immediately following the arrival of fork element 32, begins rotating and, before returning to the FIG. 2 position, moves successively through the positions shown in FIGS. 3 and 4.

As shown in FIG. 3, as wheel 4 rotates, the packet 3 housed inside seat 6 between stations 7 and 9 and adjacent to roller 23 is fed between prongs 33 of fork element 32 at station 25, and intercepts gummed label 19 supported on fork element 32; and, as wheel 4 moves from the FIG. 3 to the FIG. 4 position, prongs 33 provide for adhering the longitudinal end portions of label 19 to the two faces 10 of packet 3.

To enable labels 19 to be applied to packets 3 as described above, disk element 4' has a peripheral recess 4" substantially at station 25 and of such a shape and size as to permit fork elements 32 to cooperate with packets 3 without interfering with disk element 4'.

Upon the applied label 19 fully clearing the operating range of prongs 33, cam element 39 moves fork element 32 back to the FIG. 4 position resting against the cylindrical surface of body 27.

As shown in FIGS. 2 to 4, the pads 15 on levers 13 are only brought into contact with adjacent packets 3 as these travel between station 25 and 9, for holding the longitudinal mid portions of labels 19 firmly on to packets 3.

On reaching output station 9, each packet 3 is pushed by lift element 8 between conveyor belts 17 as already described.

All the above steps are obviously repeated for applying a label 19 to each packet 3 inside a respective seat 6 on wheel 4.

What is claimed is:

1. A device for applying sealing labels to containers; a portion of each said container (3) being defined by two substantially parallel faces (10), and by a further face (11) connecting said two faces (10); said device comprising conveying means (4) for feeding containers (3) to a labelling station (25), said conveying means (4) comprising a rotary conveyor (4) having a number of angularly equidistant seats (6) each adapted to house a respective said container (3) with said further face (11) facing downstream in relation to a traveling direction of the conveyor (4); supply means (23) for feeding labels (19) to said labelling station (25), said supply means comprising a rotary supporting element (27) rotating about an axis (23') perpendicular to a rotation axis of said rotary conveyor (4), and retaining means (30, 34) for retaining two opposite end portions of at least one said label (19); and actuating means (39) for moving said retaining means (30, 34) between a position, assumed at least at said labelling station (25), of interference with the path of each container (3) conveyed by said conveying means (4), so as to adhere respective portions of said label (19) to corresponding portions of said parallel faces and said further face (10, 11), and a position of non-interference with said path.

2. A device as claimed in claim 1, wherein said seat (6) is open at least at an edge thereof facing downstream in relation to the traveling direction of said conveyor (4).

3. A device as claimed in claim 2, wherein said retaining means comprises at least one fork element (32) including two prongs (33); each said prong (33) having a retaining device (34) for retaining a longitudinal end portion of said label (19); said actuating means (39) moving said fork element (32) between a position wherein said fork element (32) is parallel to the axis (23') of said rotary supporting element (27), and an extracted position wherein the fork element (32) is substantially perpendicular to the axis (23') of said rotary supporting element (27) and crosswise to the path of each container (3) conveyed by said conveying means (4).

4. A device as claimed in claim 1, wherein said retaining means comprises at least one fork element (32) including two prongs (33); each said prong (33) having a retaining device (34) for retaining a longitudinal end portion of said label (19); said actuating means (39) moving said fork element (32) between a position wherein said fork element (32) is parallel to the axis (23') of said rotary supporting element (27), and an extracted position wherein the fork element (32) is substantially perpendicular to the axis (23') of said rotary supporting element (27) and crosswise to the path of each container (3) conveyed by said conveying means (4).

5. A device as claimed in claim 4, wherein each said retaining device comprises suction means (34) connectable to a suction source (36).

6. A device as claimed in claim 4, wherein said fork element (32) pivots about an axis perpendicular to the rotation axis (23') of said rotary supporting element (27).

7. A device as claimed in claim 1, further comprising further conveying means (17) for conveying a number of said containers (3) and successively receiving said containers (3) from said conveying means (4); said further conveying means (17) comprising a conveying device in which said containers (3) are arranged in contact with one another.

8. A device as claimed in claim 7, further comprising positioning means (40) for separating said containers (3) on said conveying device from each container (3) at said labeling station (25).

9. A device as claimed in claim 1, further comprises clamping means (12") for holding said labels (19) on to said containers (3) conveyed by said conveying means (4).

10. A device for applying sealing labels to containers; a portion of each said container (3) being defined by two substantially parallel faces (10), and by a further face (11) connecting said two faces (10); said device comprising conveying means (4) for successively feeding containers (3) to a labelling station (25) with said further face (11) maintained downstream in relation to a traveling direction of the conveying means (4); supply means (23) for feeding labels (19) to said labelling station (25), said supply means (23) comprising a supporting element (27) rotating about a rotation axis (23') and retaining means (30, 34) supported by said supporting element (27) for retaining two opposite end portions of at least one said label (19); means (24) for applying adhesive material to said labels (19); and actuating means (39) for moving said retaining means (30, 34) between a position, assumed at least at said labelling station (25), of interference with the path of each container (3) conveyed by said conveying means (4), so as to adhere respective portions of said label (19) to corresponding portions of said parallel faces (10) and said further face (11) of said container, and a position of non-interference with said path; said retaining means comprising at least one fork element (32) including two prongs (33) mounted for pivoting movement about an axis perpendicular to the rotation axis (23') of said supporting element (27); each said prong (33) having a retaining device (34) for retaining a longitudinal end portion of said label (19); said actuating means (39) moving said fork element (32) between a position wherein the fork element (32) is parallel to the axis (23') of the supporting element (27), and an extracted position wherein the fork element (32) is substantially perpendicular to the axis (23') of said supporting element (27) and crosswise to the path of each container (3) conveyed by conveying said means (4).

11. A device as claimed in claim 10, wherein said conveying means comprises a conveyor (4) having at least one seat (6) for housing one said container (3) with said further face (11) thereof facing downstream in relation to the traveling direction of the conveyor (4).

12. A device as claimed in claim 11, wherein said seat (6) is open at least at an edge thereof facing downstream in relation to the traveling direction of said conveyor (4).

13. A device as claimed in claim 10, wherein each said retaining device comprises suction means (34) connectable to a suction source (36).

14. A device as claimed in claim 13, wherein said conveyor comprises a rotary conveyor (4) having a number of said seats in angularly equidistant spacing.

15. A device as claimed in claim 14, wherein the rotation axis (23') of said rotary supporting element (27) is perpendicular to a rotation axis of said rotary conveyor (4).

* * * * *